US009543091B2

(12) United States Patent
Okazaki

(10) Patent No.: US 9,543,091 B2
(45) Date of Patent: Jan. 10, 2017

(54) SWITCH UNIT AND GAME MACHINE

(71) Applicant: OMRON Corporation, Kyoto-shi, Kyoto (JP)

(72) Inventor: Ryoji Okazaki, Aichi (JP)

(73) Assignee: OMRON Corporation, Kyoto (JP)

( * ) Notice: Subject to any disclaimer, the term of this patent is extended or adjusted under 35 U.S.C. 154(b) by 430 days.

(21) Appl. No.: 14/168,725

(22) Filed: Jan. 30, 2014

(65) Prior Publication Data

US 2015/0213976 A1 Jul. 30, 2015

(51) Int. Cl.

| | |
|---|---|
| ***H01H 13/83*** | (2006.01) |
| ***H01H 13/86*** | (2006.01) |
| ***H01H 13/80*** | (2006.01) |
| ***G07F 17/32*** | (2006.01) |

(52) U.S. Cl.

CPC ..... *H01H 13/86* (2013.01); *G07F 17/3211* (2013.01); *G07F 17/3216* (2013.01); *H01H 13/80* (2013.01); *H01H 13/83* (2013.01); *H01H 2219/01* (2013.01); *H01H 2219/036* (2013.01); *H01H 2219/056* (2013.01); *H01H 2223/003* (2013.01); *H01H 2231/016* (2013.01)

(58) Field of Classification Search

None

See application file for complete search history.

(56) References Cited

U.S. PATENT DOCUMENTS

| | | | | |
|---|---|---|---|---|
| 4,924,044 | A * | 5/1990 | Takahashi | H04M 1/22 200/314 |
| 2007/0060352 | A1* | 3/2007 | Cole | G07F 17/32 463/37 |
| 2007/0077984 | A1* | 4/2007 | Aida | G07F 17/32 463/20 |
| 2008/0113821 | A1* | 5/2008 | Beadell | G07F 17/3216 463/46 |
| 2010/0099501 | A1* | 4/2010 | Blair | G07F 17/32 463/46 |

(Continued)

FOREIGN PATENT DOCUMENTS

| | | |
|---|---|---|
| JP | 2005-111137 A | 4/2005 |
| JP | 2006-149700 A | 6/2006 |

(Continued)

OTHER PUBLICATIONS

Patent Examination Report issued in corresponding Australian Application No. 2014200641, mailed on Oct. 30, 2014 (5 pages).

*Primary Examiner* — Tramar Harper

(74) *Attorney, Agent, or Firm* — Osha Liang LLP

(57) ABSTRACT

A switch unit has a display part that displays an image in at least one input area, a substrate provided above the display part, the substrate having a contact, and at least one substrate opening configured to allow the image in the at least one input area to be viewed from above, an operating button case that covers the substrate, having at least one button case opening, at least one operating button that has translucency, and that is freely pressed down through the at least one button case opening of the operating button case and causes conduction of the contact by being pressed down, light sources mounted on the substrate, that illuminate an area surrounding the at least one operating button, and a light transmissive water-proof sheet made of an elastic member.

12 Claims, 11 Drawing Sheets

(56) References Cited

U.S. PATENT DOCUMENTS

| | | | | |
|---|---|---|---|---|
| 2014/0094308 | A1* | 4/2014 | Lesley | A63F 13/02 463/37 |
| 2014/0197015 | A1* | 7/2014 | Ikeuchi | H01H 13/023 200/314 |
| 2015/0248822 | A1* | 9/2015 | Okazaki | G07F 17/3209 463/20 |

FOREIGN PATENT DOCUMENTS

| | | | | |
|---|---|---|---|---|
| JP | WO 2014/080551 | A1 * | 5/2014 | H01H 2013/026 |
| WO | 2013/047711 | A1 | 4/2013 | |

* cited by examiner

| | ABSORPTION COEFFICIENT OF SILICONE | TRANSMITTANCE FACTOR (ASSUMPTION) | ABSORPTION COEFFICIENT | DIRECT LIGHT (TRANSMITTING LIGHT) | | BLOCKING LIGHT (LEAKING LIGHT) | |
|---|---|---|---|---|---|---|---|
| | | | | TRANSMITTANCE [%] | TRANSMITTED LIGHT [lm] | TRANSMITTANCE [%] | TRANSMITTED LIGHT [lm] |
| SILICONE (TRANSLUCENT WHITE) | 1.407 | 1 | 1.4 | 83.26 | 249.8 | 57.72 | 173.16 |
| SILICONE (LIGHT GRAY) | | 3 | 4.2 | 57.72 | 173.2 | 19.23 | 57.69 |
| SILICONE (MEDIUM GRAY) | | 5 | 7.0 | 40.01 | 120.0 | 6.41 | 19.22 |
| SILICONE (DARK GRAY) | | 10 | 14.1 | 16.01 | 48.0 | 0.41 | 1.23 |

| THICKNESS | | DIFFERENCE (MULTIPLE) | ABSORPTION COEFFICIENT | TRANSMITTED LIGHT [lm] | BLOCKING LIGHT [lm] |
|---|---|---|---|---|---|
| LIGHT TRANSMITTING PORTION [mm] | LIGHT BLOCKING PORTION [mm] | | | | |
| | 0.6 | 2 | 10.6 | 75.9 | 19.2 |
| | 0.9 | 3 | 7.0 | 120.0 | 19.2 |
| | 1.2 | 4 | 5.2 | 152.3 | 19.9 |
| | 1.5 | 5 | 4.2 | 173.2 | 19.2 |
| 0.3 | 1.8 | 6 | 3.5 | 189.8 | 19.2 |
| | 2.1 | 7 | 3.0 | 202.3 | 19.0 |
| | 2.4 | 8 | 2.6 | 213.8 | 19.9 |
| | 2.7 | 9 | 2.3 | 221.7 | 19.8 |
| | 3.0 | 10 | 2.1 | 227.9 | 19.2 |

SWITCH UNIT AND GAME MACHINE

BACKGROUND OF THE INVENTION

1. Technical Field

The present invention relates to a switch unit and a game machine, and particularly to the water-proof structure and the light partition structure of a push-button switch unit and a game machine equipped with the same.

2. Related Art

Conventionally, there has been a game machine called a slot machine. In a slot machine, a plurality of reels on each of which a plurality of types of symbols are displayed are spun. Then, a winning combination ("yaku") is determined on the basis of a matching pattern of symbols that are displayed when the reels are stopped and the matched symbols, and a prize is given according to the determined winning combination and the number of bets.

Further, operations such as the setting of the number of bets and the spinning of the reels have been performed by pressing a button. More specifically, a player presses a bet button with his/her hand to determine the number of bets as many times as the number of bets to be set, and presses a reel spinning button with his/her hand to start the spin of the reels. The reels are automatically stopped by the control of the machine.

In the meantime, a slot machine is placed, for example, in a casino. In a casino, not only slot machines manufactured by a single game machine manufacturer, but also slot machines manufactured by various game machine manufacturers are placed. A player selects a slot machine that suits his/her preference from slot machines manufactured by various game machine manufacturers, and plays the selected one. Therefore, each casino takes the business strategy to ensure superiority to its competitors by placing slot machines that are popular to players. Therefore, each game machine manufacturer makes efforts to provide slot machines that can attract the attention of players.

For example, Japanese Unexamined Patent Publication No. 2005-111137 (published on Apr. 28, 2005) discloses a slot machine as a game machine that is provided with a display part including a touch panel. In this slot machine, a character and a numeric keypad are displayed on the display part, and the setting of the number of bets and the start of spin of reels are performed by using the touch panel.

Further, Japanese Unexamined Patent Publication No. 2006-149700 (published on Jun. 15, 2006) discloses a slot machine in which an operating switch is arranged in an inclined surface in view of an easy pressing operation.

SUMMARY

However, in the conventional switch unit and the conventional game machine, when liquid such as drinking water is dropped onto the operating switch during playing a game, the liquid that has entered the inside of the switch unit may get hard. As a result, a contact is fixed and an image becomes difficult to view. Therefore, the water-proof structure of the contact may be required.

Further, in order to achieve superiority in an operating switch of a slot machine to products of competitors, an operating switch that performs a light emitting presentation around a button as an appeal other than display has been developed.

Therefore, when performing such a light emitting presentation, the water-proof structure for the light source may also be required.

One or more embodiments of the present invention provides a switch unit and a game machine that have an appropriate water-proof structure for a contact and a light source when a light emitting presentation is performed around an operating button by the light source.

According to one or more embodiments of the present invention, a switch unit includes: a display part configured to display an image in at least one input area; a substrate provided above the display part, the substrate comprising a contact and at least one substrate opening configured to allow the image in the at least one input area to be viewed from above; an operating button case configured to cover the substrate, the operating button case comprising at least one button case opening; and at least one operating button having translucency, the at least one operating button being configured to be freely pressed down through the at least one button case opening of the operating button case and cause conduction of the contact by being pressed down. The switch unit further includes light sources mounted on the substrate, the light sources being configured to illuminate an area surrounding the at least one operating button, and a light transmissive water-proof sheet made of an elastic member, the light transmissive water-proof sheet being provided between the display part and the at least one operating button to cover the substrate and comprising at least one sheet opening formed thereon at a position facing the at least one input area. In the switch unit, the light transmissive water-proof sheet includes: a contact conducting portion configured to face and come into contact with the contact of the substrate to cause conduction of the contact by pressing down the at least one operating button; a down portion configured to cover a circumference of the substrate; and a light transmitting portion formed on a top surface thereof, the light transmitting portion configured to transmit light from the light sources therethrough.

In accordance with one or more embodiments of the present invention, the switch unit includes: a display part configured to display an image in at least one input area; a substrate provided above the display part, the substrate comprising a contact and at least one substrate opening configured to allow the image in the at least one input area to be viewed from above; an operating button case configured to cover the substrate, the operating button case comprising at least one button case opening; and at least one operating button having translucency, the at least one operating button being configured to be freely pressed down through the at least one button case opening of the operating button case and cause conduction of the contact by being pressed down.

In such a switch unit, the operating button case has the button case opening through which the operating button passes so as to be freely pressed down. The button case opening is formed at a position corresponding to the input area of the display part. Therefore, when liquid such as drinking water is spilled onto the switch unit, the liquid flows through a gap between the button case opening and the operating button. As a result, the liquid may enter the contact of the substrate located below the operating button case. Further, in one or more embodiments of the present invention, since the substrate is further equipped with the light sources which illuminate the area surrounding the operating button, the water-proof structure for the light sources is also required.

Therefore, in one or more embodiments of the present invention, the switch unit further includes a light transmissive water-proof sheet made of an elastic member, the light transmissive water-proof sheet being provided between the display part and the at least one operating button to cover the substrate and comprising at least one sheet opening formed thereon at a position facing the at least one input area. In the switch unit, the light transmissive water-proof sheet includes: a contact conducting portion configured to face and come into contact with the contact of the substrate to cause conduction of the contact by pressing down the at least one operating button; a down portion configured to cover a circumference of the substrate; and a light transmitting portion formed on a top surface thereof, the light transmitting portion configured to transmit light from the light sources therethrough.

As a result, the contact and the light sources are provided in the substrate, and the substrate is sealed by the surface of the light transmissive water-proof sheet and the down portion which covers the circumference of the substrate. In this case, since the light transmissive water-proof sheet is made of an elastic member, the lower end of the down portion of the light transmissive water-proof sheet can be closely attached to the display part.

Therefore, even if liquid flows through a gap between the button case opening and the operating button, after the liquid reaches the light transmissive water-proof sheet, the liquid flows along the surface of the down portion on the sheet opening side, and then drops onto the display part. As a result, the contact and the light sources do not get wet.

Further, in one or more embodiments of the present invention, the light transmitting portion which transmits light from the light sources therethrough is formed on the top surface of the light transmissive water-proof sheet. Therefore, the light emitting presentation by the light sources can be ensured.

Therefore, it may be possible to provide the switch unit that has an appropriate water-proof structure for the contact and the light sources when a light emitting presentation is performed around the operating button by the light sources.

In accordance with one or more embodiments of the present invention, the light transmissive water-proof sheet includes one kind of colored elastic member. Further, a part of the light transmissive water-proof sheet other than the light transmitting portion is formed as a light blocking portion configured to block light from the light sources. Furthermore, according to one or more embodiments of the present invention, the light transmitting portion is thinner than the light blocking portion.

That is, according to one or more embodiments of the present invention, a part of light transmissive water-proof sheet, the part being required for the light emitting presentation, transmit light therethrough, but the other part block light.

Therefore, in one or more embodiments of the present invention, the light transmissive water-proof sheet includes one kind of colored elastic member. Further, a part of the light transmissive water-proof sheet other than the light transmitting portion is formed as a light blocking portion configured to block light from the light sources. That is, the light transmissive water-proof sheet is made of an elastic member such as rubber. In such an elastic member, the absorbance of light is proportional to the thickness and the color thereof. Therefore, in one or more embodiments of the present invention, the light transmitting portion of the light transmissive water-proof sheet is made thinner than the light blocking portion thereof, and the light transmissive water-proof sheet has a color.

As a result, the part required for the light emitting presentation is ensured by the thin light transmitting portion and light blocking in the other part is appropriately ensured by the light blocking portion thicker than the light transmitting portion by virtue of the thickness and the color of the one kind of light transmissive water-proof sheet.

In accordance with one or more embodiments of the present invention, the light transmissive water-proof sheet includes colored silicone rubber having an absorption coefficient of four to seven.

Accordingly, the part required for the light emitting presentation is ensured by the thin light transmitting portion and light blocking in the other part is appropriately ensured by the light blocking portion thicker than the light transmitting portion by virtue of the thickness and the gray color having an absorption coefficient of four to seven of the one kind of silicone rubber which is easily available.

In accordance with one or more embodiments of the present invention, the light transmissive water-proof sheet includes a light blocking partition configured to block light between adjacent ones of the light sources and formed of the light blocking portion.

That is, in a switch unit which performs a light emitting presentation around operating buttons by the light sources, if light around an operating button enters another operating button that is adjacent thereto, an appeal made by the light emission becomes difficult to recognize.

Accordingly, in one or more embodiments of the present invention, the light transmissive water-proof sheet includes a light blocking partition configured to block light between adjacent ones of the light sources and formed of the light blocking portion. Therefore, it may be possible to prevent light from light sources around an operating button from entering the presentation performed around another operating button adjacent thereto through the inside of the transmissive water-proof sheet by virtue of the light blocking partition formed of the light blocking portion.

As a result, it may be possible to provide the switch unit that has a light partition structure that prevents light in an operating button from leaking to another operating button adjacent thereto.

Further, the light blocking partition is formed of the light blocking portion, and formed on substantially the center of the thin light transmitting portion which is formed on the surface of the transmissive water-proof sheet. Therefore, the light blocking partition has a function as a thick rib. As a result, it may be possible to prevent the light transmitting portion having a thin film thickness from warping to thereby prevent dropped liquid from staying thereon.

In accordance with one or more embodiments of the present invention, a light diffusion frame configured to be fitted around the at least one operating button and direct light from the light sources along the circumference of the at least one operating button are provided in the at least one button case opening of the operating button case.

Accordingly, it may be possible to allow light from a point light source such as an LED to illuminate the area surrounding the operating button along the sides thereof. Therefore, even light from a point light source can be represented as linear light.

In accordance with one or more embodiments of the present invention, a game machine is provided with a switch unit according to one or more embodiments of the present invention.

Therefore, it may be possible to provide the game machine that is provided with the switch unit that has an appropriate water-proof structure for the contact and the light sources when a light emitting presentation is performed around the operating button by the light sources.

As described above, the switch unit of one or more embodiments of the present invention includes light sources mounted on the substrate, the light sources being configured to illuminate an area surrounding the at least one operating button, and a light transmissive water-proof sheet made of an elastic member, the light transmissive water-proof sheet being provided between the display part and the at least one operating button to cover the substrate and comprising at least one sheet opening formed thereon at a position facing the at least one input area. The light transmissive water-proof sheet includes: a contact conducting portion configured to face and come into contact with the contact of the substrate to cause conduction of the contact by pressing down the at least one operating button; a down portion configured to cover a circumference of the substrate; and a light transmitting portion formed on a top surface thereof, the light transmitting portion configured to transmit light from the light sources therethrough.

Further, the game machine of one or more embodiments of the present invention is provided with a switch unit according to one or more embodiments of the present invention.

Therefore, it may be possible to provide the switch unit and the game machine that have an appropriate water-proof structure for the contact and the light sources when a light emitting presentation is performed around the operating button by the light sources.

DETAILED DESCRIPTION

Embodiments of the present invention will be described with reference to FIGS. 1 to 14. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

A switch unit used in a game machine such as a so-called slot machine will be described below. However, the present invention is not limited to a slot machine. That is, one or more embodiments of the present invention may be applied to any devices that operate by receiving an operation by a user through a switch unit. For example, a game machine according to one or more embodiments of the present invention can also be applied to a card game machine such as a poker game machine and a mah-jong game machine.

Figure 2:
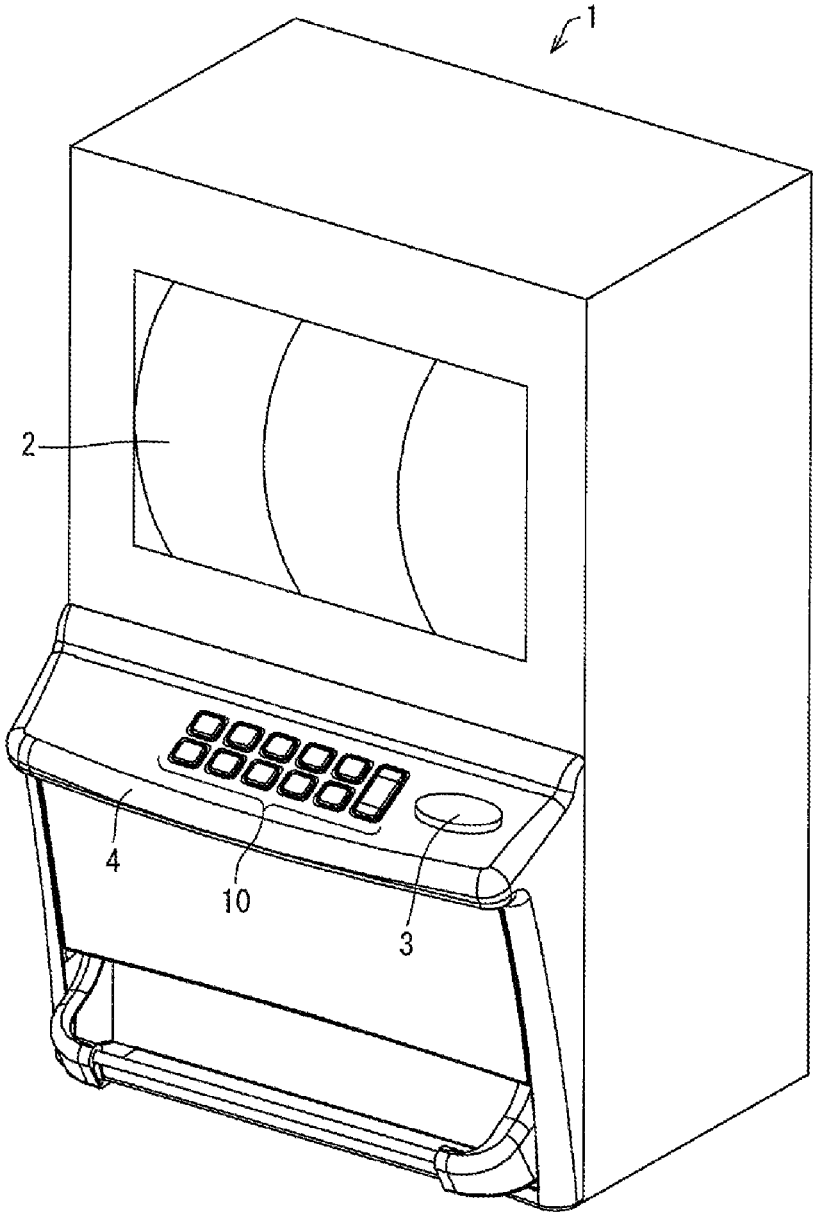
FIG. 2 is a perspective view illustrating the configuration of a slot machine as a game machine that is provided with the switch unit.

First, a slot machine as a game machine that is provided with a switch unit according to one or more embodiments of the present invention will be described with reference to FIG. 2. FIG. 2 is a perspective view illustrating the configuration of the slot machine as a game machine that is provided with the switch unit.

As illustrated in FIG. 2, a slot machine 1 as a game machine includes a display monitor 2 which is provided at a position at the eye level of a player on the top part of a casing 4, and a switch unit 10 which is provided at a position near the center of the casing 4 on which a hand of a player is placed in such a manner that an operating part thereof is slightly inclined toward a player. In this manner, the switch unit 10 is provided on a lower part of the center on the front of the slot machine 1.

A plurality of reels are displayed on the display monitor 2. The reels can be spun by an operation by a player. According to symbols indicated on the stopped reels, a winning combination ("yaku") is determined. Then, a prize is given according to the determined winning combination. In the display of the reels, equivalents of the reels may be displayed on a display screen such as a liquid crystal display. Alternatively, the reels themselves may be arranged on the display monitor 2.

The switch unit 10 receives an operation by a player. In one or more embodiments of the present invention, the switch unit 10 receives operations such as an operation for specifying the number of bets and an operation for spinning the reels when a player plays the slot machine 1. In the slot machine 1 according to one or more embodiments of the present invention, the start of spin of the reels is performed by pressing a reel spinning button 3 which is separately provided on the side of the switch unit 10.

Figure 3:
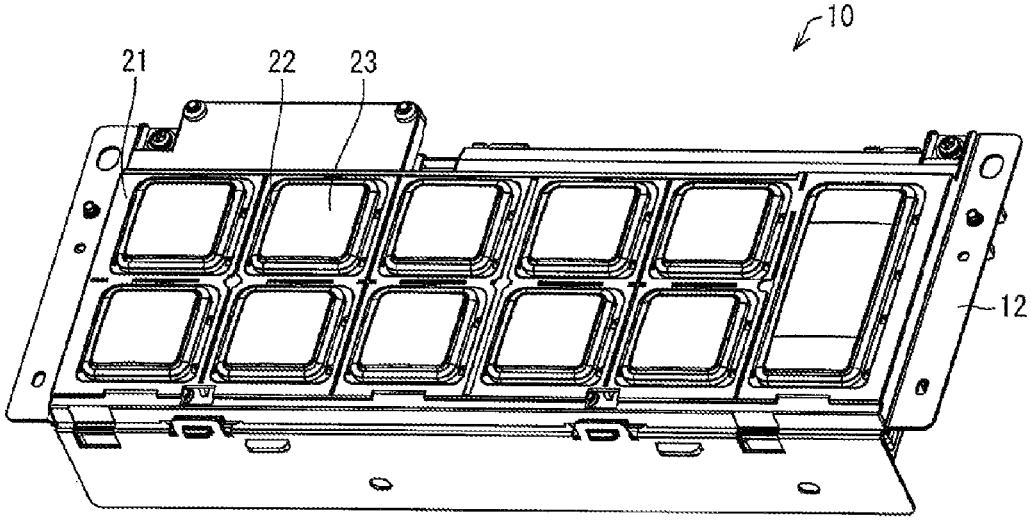
FIG. 3 is a perspective view illustrating the configuration of the switch unit.
Figure 4:
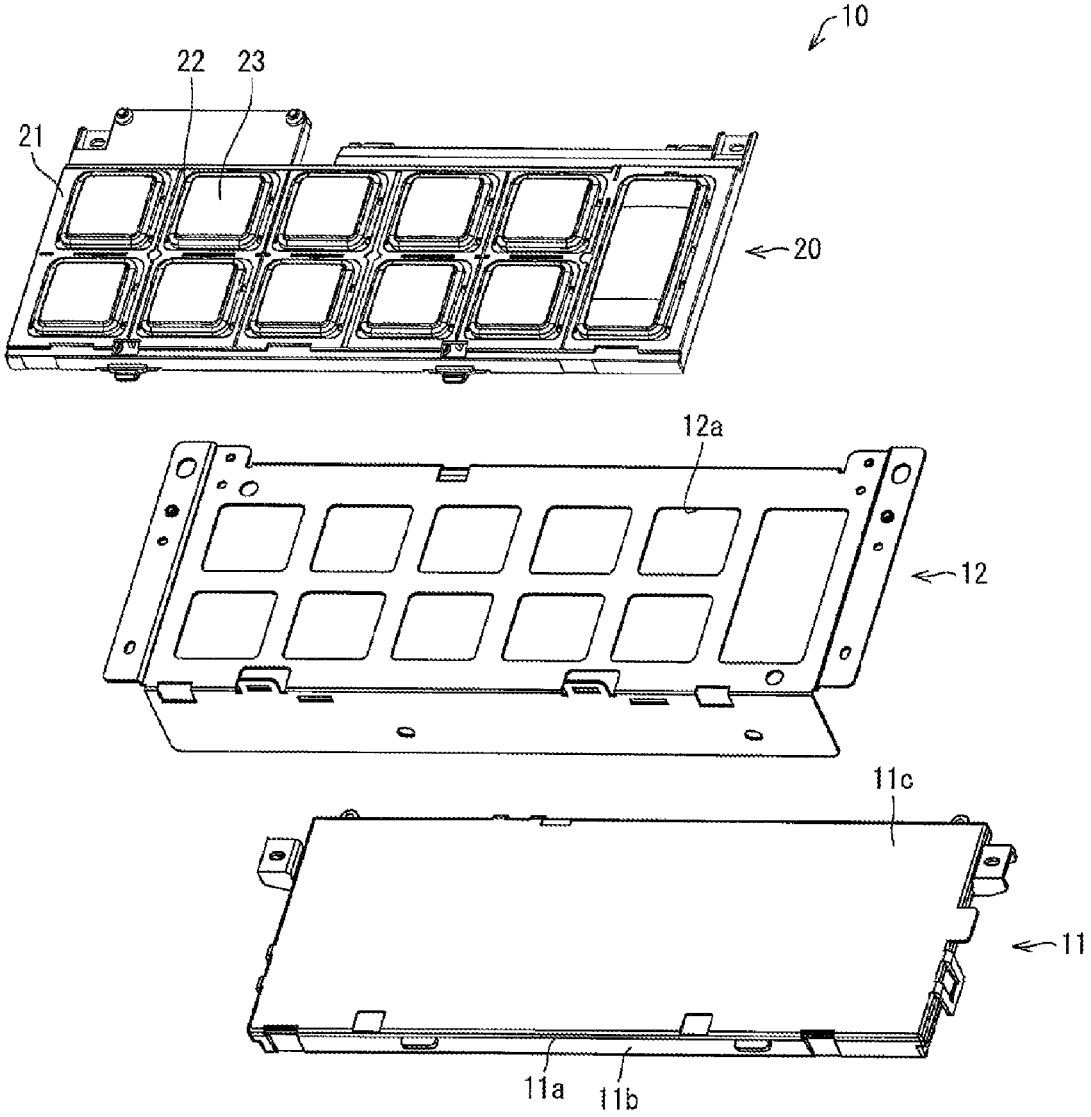
FIG. 4 is an exploded perspective view illustrating the configuration of the switch unit.
Figure 5:
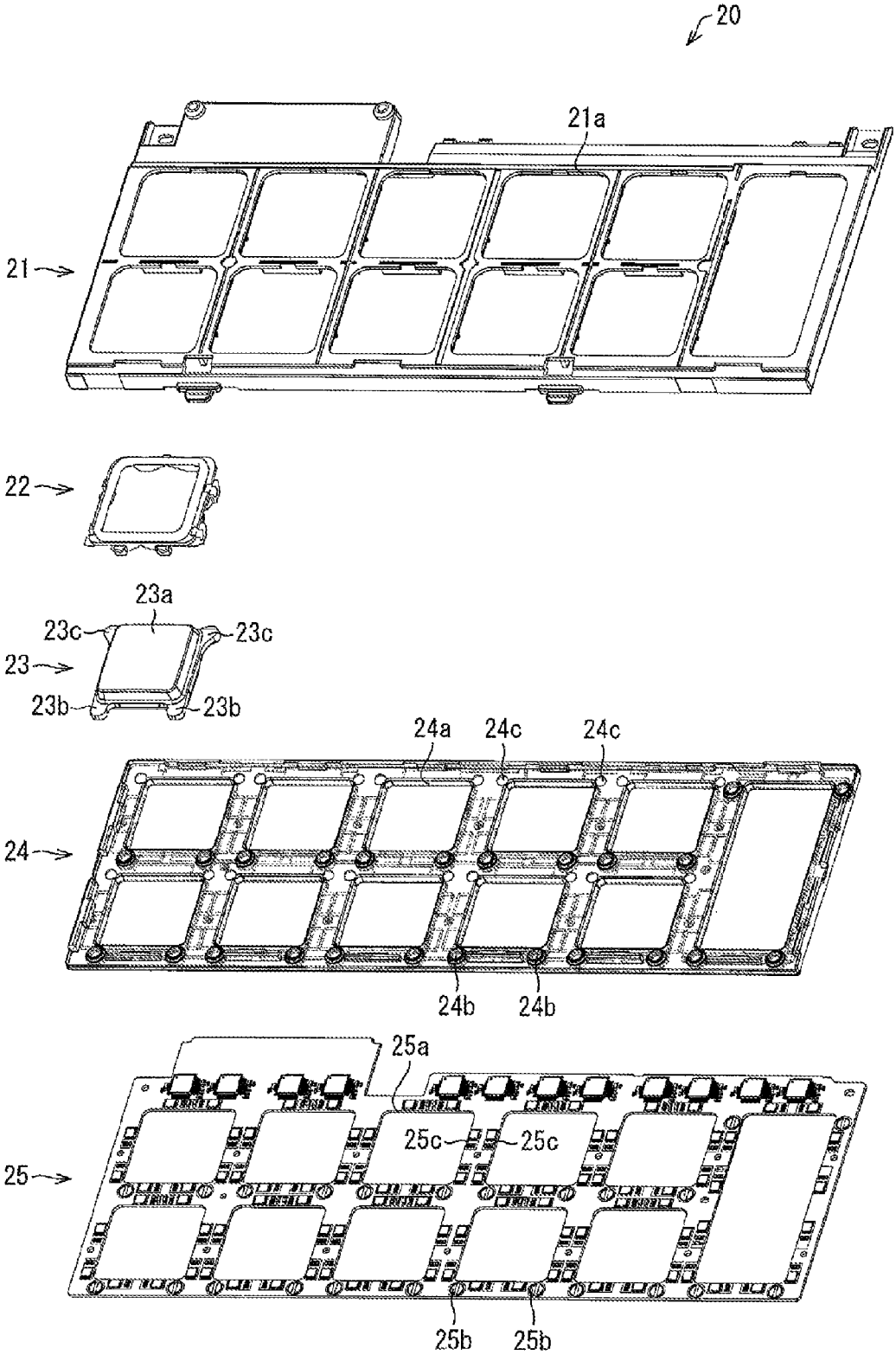
FIG. 5 is an exploded perspective view illustrating the configuration of a button unit in the switch unit.
Figure 6:
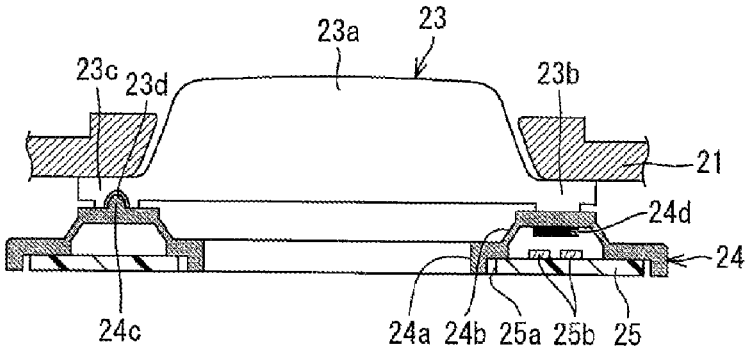
FIG. 6 is a cross-sectional view illustrating a contact pressing portion of an operating button and a contact of a substrate in the button unit.
Figure 7:
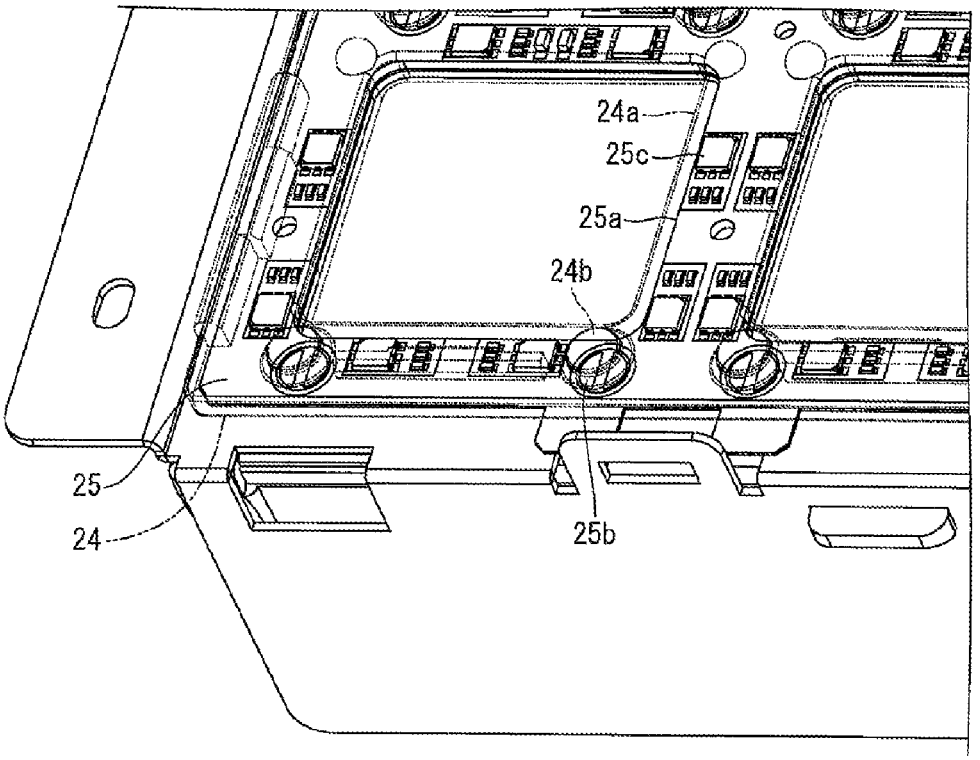
FIG. 7 is a main part perspective view illustrating the configuration of a light source and the contact on the substrate in the button unit.
Figure 8:
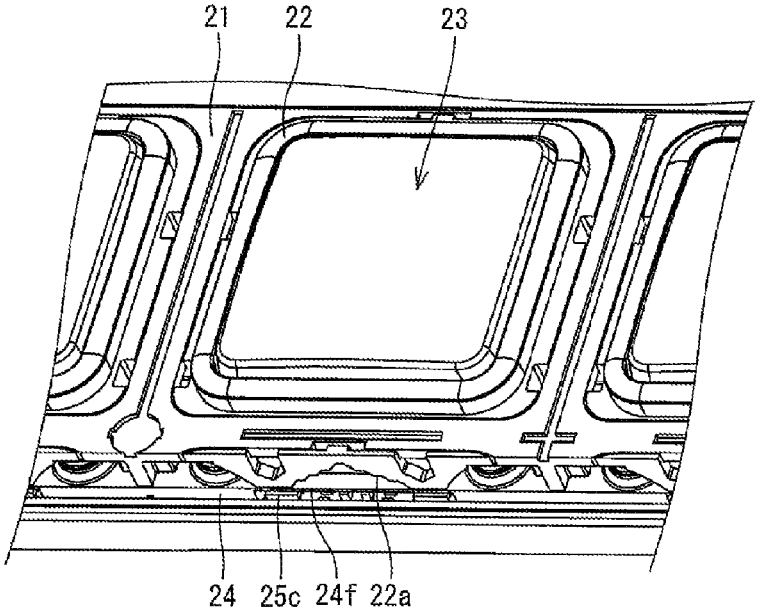
FIG. 8 is a main part perspective view illustrating the configuration of a light guide frame body in the button unit.
Figure 9:
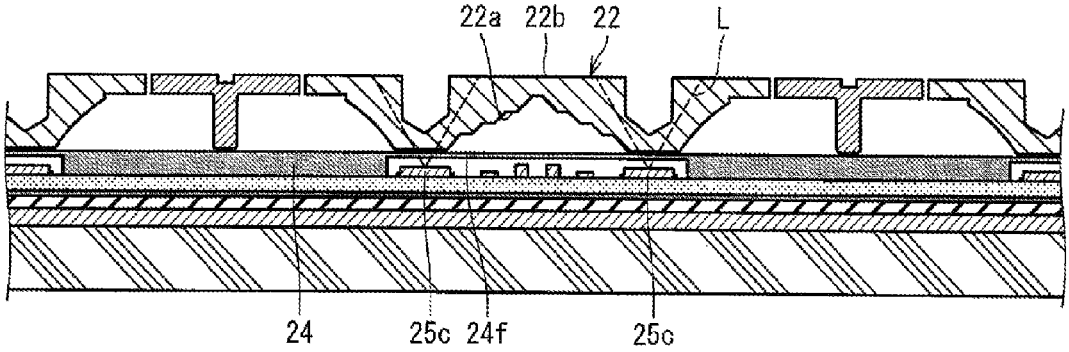
FIG. 9 is a cross-sectional view illustrating the configuration of the light guide frame body in the button unit.

A detailed configuration of the switch unit 10 will be described with reference to FIGS. 3 to 9. FIG. 3 is a perspective view illustrating the configuration of the switch unit. FIG. 4 is an exploded perspective view illustrating the configuration of the switch unit. FIG. 5 is an exploded perspective view illustrating the configuration of a button unit in the switch unit. FIG. 6 is a cross-sectional view illustrating a contact pressing portion of an operating button and a contact of a substrate in the button unit. FIG. 7 is a main part perspective view illustrating the configuration of a light source and the contact on the substrate in the button unit. FIG. 8 is a main part perspective view illustrating the configuration of a light guide frame body in the button unit. FIG. 9 is a cross-sectional view illustrating the configuration of the light guide frame body in the button unit.

The switch unit 10 can be separated from the slot machine 1 as illustrated in FIG. 3. The switch unit 10 according to one or more embodiments of the present invention has an integrated structure of a plurality of operating buttons 23.

As illustrated in FIG. 4, the switch unit 10 includes a display unit 11 as a display part, a bracket 12, and a button unit 20 which are arranged in this order from bottom to top. The display unit 11 and the button unit 20 are integrated with each other with the bracket 12 interposed therebetween. Therefore, in the switch unit 10 of one or more embodiments of the present invention, even if liquid is dropped onto the button unit 20, the dropped liquid flows through the top surface of the display unit 11, and is discharged therefrom as will be described later.

The display unit 11 has a liquid crystal display (LCD) 11*a*, an LCD case 11*b* which holds the LCD 11*a* from the bottom thereof, and a translucent protection sheet 11*c* which covers the entire surface of the LCD 11*a* to protect the LCD 11*a*. The LCD 11*a* is a liquid crystal display device, and displays a predetermined image such as a picture and character on positions that can be visually recognized through transparent operating buttons which will be described later, that is, input areas.

The bracket 12 is a support plate for integrating the display unit 11 and the button unit 20 with each other as described above. The bracket 12 has bracket openings 12*a* which are formed at positions corresponding to the positions of the respective operating buttons, that is, the positions corresponding to the respective display areas of the LCD 11*a*.

The button unit 20 has the plurality of transparent operating buttons 23 and light guide frame bodies 22 as light diffusion frames which are provided around the respective operating buttons 23 and perform display from the LCDs as light sources. By pressing down an operating button 23, the button unit 20 serves as a switch of an input area corresponding to a display below the operating button 23 in the LCD 11*a*. Further, a cover (not shown) which covers an operating button case 21 with the operating buttons 23 exposed therefrom can be provided over the button unit 20.

Specifically, as illustrated in FIG. 5, the button unit 20 includes the operating button case 21, the light guide frame bodies 22, the operating buttons 23, a rubber sheet 24 as a light transmissive water-proof sheet which is made of an elastic member, and a printed circuit board (PCB) 25 as a substrate.

The operating button case 21 is formed of, for example, a black plastic or the like. Further, the operating button case 21 has the same number of button case openings 21*a* as the number of the operating buttons 23 at positions corresponding to the positions of the respective operating buttons 23. The positions of the button case openings 21*a* correspond to the respective input areas of the LCD 11*a*. Accordingly, the operating buttons 23 protrude above the operating button case 21 through the button case openings 21*a*, and are loosely fitted so as to be freely pressed down. Above, an example in which the number of the provided operating buttons 23 is eleven is described. However, the number of operating buttons 23 is not limited thereto. The number of operating buttons 23 may be less or more than eleven, or may also be one.

The operating button 23 is made of a translucent rectangular parallelepiped member such as transparent plastic. The operating button 23 has a push button 23*a*, contact pressing portions 23*b* which protrude from lower two corners of the push button 23*a*, and support/fixation portions 23*c* which protrude from the other lower two corners of the push button 23*a*.

Each of four side walls of the push button 23*a* which is made of a rectangular parallelepiped member is formed into an inclined surface that widens outwardly toward the bottom. The inclined surface is inclined at an angle of, for example, 10 to 20° with respect to a vertical surface so as to form an obtuse angle downward. This prevents a display on a side wall WS located on the far side with respect to a payer from becoming difficult to view due to light reflected by the side wall WS. The inclination of the push button 23*a* on the side wall is not necessarily formed on each of the four side walls thereof, and only required to be formed on at least one side wall located on the far side with respect to a player.

As illustrated in FIG. 5, the rubber sheet 24 is arranged under the operating buttons 23. The rubber sheet 24 has sheet openings 24*a* which are formed at positions corresponding to the positions of the respective operating buttons 23, that is, the positions facing the respective input areas of the LCD 11*a*. The rubber sheet 24 is made of an elastic member such as silicone rubber, and has a gray color.

Further, the rubber sheet 24 has projections 24*b* which are provided at positions corresponding to the positions of the respective contact pressing portions 23*b* of the operating buttons 23. As illustrated in FIG. 6, each of the projections 24*b* has a cavity on the back thereof. A carbon electrode 24*d* as a contact conducting portion is provided inside the cavity so as to face electrode terminals 25*b*, 25*b* as a contact provided on the PCB 25.

The contact pressing portions 23*b* of the operating buttons 23 are in contact with the respective projections 24*b* of the rubber sheet 24. When an operating button 23 is pressed down, a contact pressing portion 23*b* of the operating button 23 compresses the corresponding projection 24*b* of the rubber sheet 24. As a result, the projection 24*b* comes into contact with the electrode terminals 25*b*, 25*b* thereacross, which causes conduction between the electrode terminals 25*b*, 25*b*, and serves as switching on.

At this point, since the projection 24*b* of the rubber sheet 24 has elasticity, the projection 24*b* presses back the contact pressing portion 23*b* of the operating button 23 after being compressed. Accordingly, a pressing feeling of the operating button 23 can be provided, and the operating button 23 serves as a push button. In the above configuration, the rubber sheet 24 covers at least the electrode terminals 25*b*, 25*b* of the PCB 25 by the projections 24*b*.

Further, as described above, the operating button 23 illustrated in FIG. 5 has the support/fixation portions 23*c*, 23*c* which protrude from the other lower two corners of the push button 23*a*. In addition, support projections 24*c* are provided on the rubber sheet 24 at positions facing the respective support/fixation portions 23*c*, 23*c*.

As illustrated in FIG. 6, the support/fixation portions 23*c* of the operating button 23 have fixation holes 23*d*. Therefore, by inserting the two support projections 24*c*, 24*c* of the rubber sheet 24 into the respective fixation holes 23*d*, 23*d* of the support/fixation portions 23*c* in the operating button 23, it is possible to fix the operating button 23 so as not to move in the lateral direction on the rubber sheet 24.

As illustrated in FIG. 5, the PCB 25 is a printed circuit board on which necessary wirings are formed. The PCB 25 detects the pressing-down of an operating button 23, and thereby performs predetermined processing. The PCB 25 has PCB openings 25*a* as substrate openings which are formed at positions corresponding to the positions of the push button 23*a* of the respective operating buttons 23, that is, the positions corresponding to the respective input areas of the LCD 11*a*.

As described above, the PCB 25 has the electrode terminals 25*b*, 25*b* as contacts which are provided at positions directly below the contact pressing portions 23*b* of the operating buttons 23 shown in FIG. 5 and FIG. 6. Therefore, when an operating button 23 is pressed down, a contact pressing portion 23*b* of the operating button 23 applies pressing force to the corresponding projection 24*b* of the rubber sheet 24. Accordingly, the carbon electrode 24*d* which is provided on the back of the projection 24*b* comes into contact with two electrode terminals 25*b*, 25*b* which are provided with a space therebetween. The PCB 25 thereby recognizes that there has been conduction between the electrode terminals 25*b*, 25*b* at this position. As a result, the PCB 25 can detect that the operating button 23 that is located above the electrode terminals 25*b*, 25*b* at this position has been pressed down. In one or more embodiments of the present invention, since the carbon electrodes 24*d* of the PCB 25 cannot be viewed from the upper side of the switch unit 10, the carbon electrodes 24*d* are not necessarily transparent electrodes. Therefore, from this point of view, a general touch panel input device is not used in the switch unit 10 of one or more embodiments of the present invention.

Figure 11:
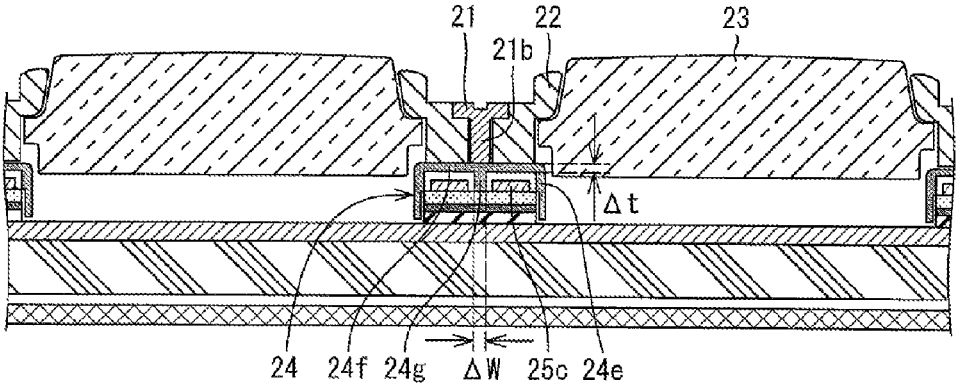
FIG. 11 is a cross-sectional view illustrating the light source, and a light transmitting portion and a light blocking partition of a rubber sheet in the button unit.

Further, in one or more embodiments of the present invention, as illustrated in FIG. 7, light-emitting diodes (LEDs) 25*c* as light sources which illuminate areas surrounding the respective operating buttons 23 are provided around the PCB openings 25*a* on the edges of the PCB 25. The LEDs 25*c* are arranged below the light guide frame bodies 22 which are provided around the respective operating buttons 23. The LEDs 25*c* are sealed by a down portion 24*e* of the rubber sheet 24 as illustrated in FIG. 11 which will be described later.

The LEDs 25*c* perform presentation of light emitted from the LEDs 25*c* on the areas surrounding the respective operating buttons 23. However, each of the LEDs 25*c* is a point light source, and therefore cannot disperse light into a long linear shape.

Therefore, in one or more embodiments of the present invention, the light guide frame bodies 22 illustrated in FIG. 5 are provided above the LEDs 25*c*. As illustrated in FIGS. 8 and 9, each of the light guide frame bodies 22 has a corrugated mountain form 22*a* at a position facing adjacent LEDs 25*c*. Accordingly, direct light having a high luminance from each of the LEDs 25*c* is transmitted through a light transmitting portion 24*f* of the rubber sheet 24, and then comes into contact with the corrugated mountain form 22*a* which is a boundary between V-shapes of the light guide frame body 22. As a result, the light is dispersed, and the luminance thereof is thereby reduced. At this point, side light from each of the LEDs 25*c* radially spreads out along an inclined shape of the light guide frame body 22, thereby supplying uniform light. Therefore, a difference in luminance between the direct light and the side light is reduced. Light from each of the LEDs 25*c* is prevented from leaking out to an area surrounding an operating button 23 adjacent thereto by a light blocking partition 24*g* of the rubber sheet 24 which will be described later. Further, light from each of the LEDs 25*c*, the light being dispersed by the light guide frame body 22, is prevented from leaking out to an area surrounding an operating button 23 adjacent thereto by a partition 21*b* of the operating button case 21.

As described above, according to the configuration of the switch unit 10, the rubber sheet 24, the operating button case 21, and the operating buttons 23 are provided above the PCB 25. The rubber sheet 24 covers the electrode terminals 25*b*, 25*b*, and has the sheet openings 24*a* at positions corresponding to the respective input areas of the LCD 11*a*. The operating button case 21 is provided above the rubber sheet 24, and has the button case openings 21*a* at positions corresponding to the respective input areas of the LCD 11*a*. Each of the operating buttons 23 has the translucent push button 23*a* and at least one contact pressing portion 23*b* which laterally protrudes from the lower end of the push button 23*a*. The push button 23*a* is loosely fitted with respect to the corresponding button case opening 21*a* and the corresponding sheet opening 24*a* so as to be freely pressed down. Each of the operating buttons 23 causes conduction of electrode terminals 25*b*, 25*b* of the PCB 25 by allowing the carbon electrode 24*d* to come into contact with the electrode terminals 25*b*, 25*b* by the contact pressing portion 23*b* by a press-down operation of the push button 23*a* toward the input area.

Therefore, since a pressing operation to the PCB 25 is performed through the physical operating button 23, an intuitive operational feeling and a click feeling can be obtained by pressing down the operating button 23.

As a result, a switching on operation can be performed by a physical action as pressing down the operating button 23. Therefore, it is not necessary to visually confirm as to whether the operation has been completed in each operation. Accordingly, a switch unit 10 that can provide a speed feeling and a quick feeling can be provided.

Further, the switch unit 10 can illuminate the areas surrounding the respective operating buttons 23 by the LED 25*c* and display various pieces of information (characters, pictures, etc.) on the top surfaces of the operating buttons 23 while maintaining an operational feeling and a quick feeling like a push button. As a result, the switch unit 10 can provide a user interface that attracts customers while maintaining the advantages of a push-button switch unit.

In other words, in the switch unit 10 of one or more embodiments of the present invention, it is possible to give an operational feeling that cannot be provided by a touch panel to a player. In addition, it is possible to provide the switch unit 10 that is attractive to a player by displaying an image displayed on the LCD 11*a* on each of the operating buttons 23 and illuminating the areas surrounding the respective operating buttons 23.

Further, in the switch unit 10 of one or more embodiments of the present invention, the light guide frame bodies 22 which are fitted around the respective operating buttons 23 and direct light from the LEDs 25*c* along the circumferences of the operating buttons 23 are provided in the button case openings 21*a* of the operating button case 21. Accordingly, the light guide frame bodies 22 allow light from point light sources such as the LEDs 25*c* to direct the areas surrounding the respective operating buttons 23 along the sides thereof. Therefore, even light from a point light source such as the LED 25*c* can be represented as linear light.

In one or more embodiments of the present invention, the operating button case 21 has the button case openings 21*a* with which the respective operating buttons 23 are loosely fitted so as to be freely pressed down. The button case openings 21*a* are formed at positions corresponding to the respective input areas of the LCD 11*a*.

Figure 1:
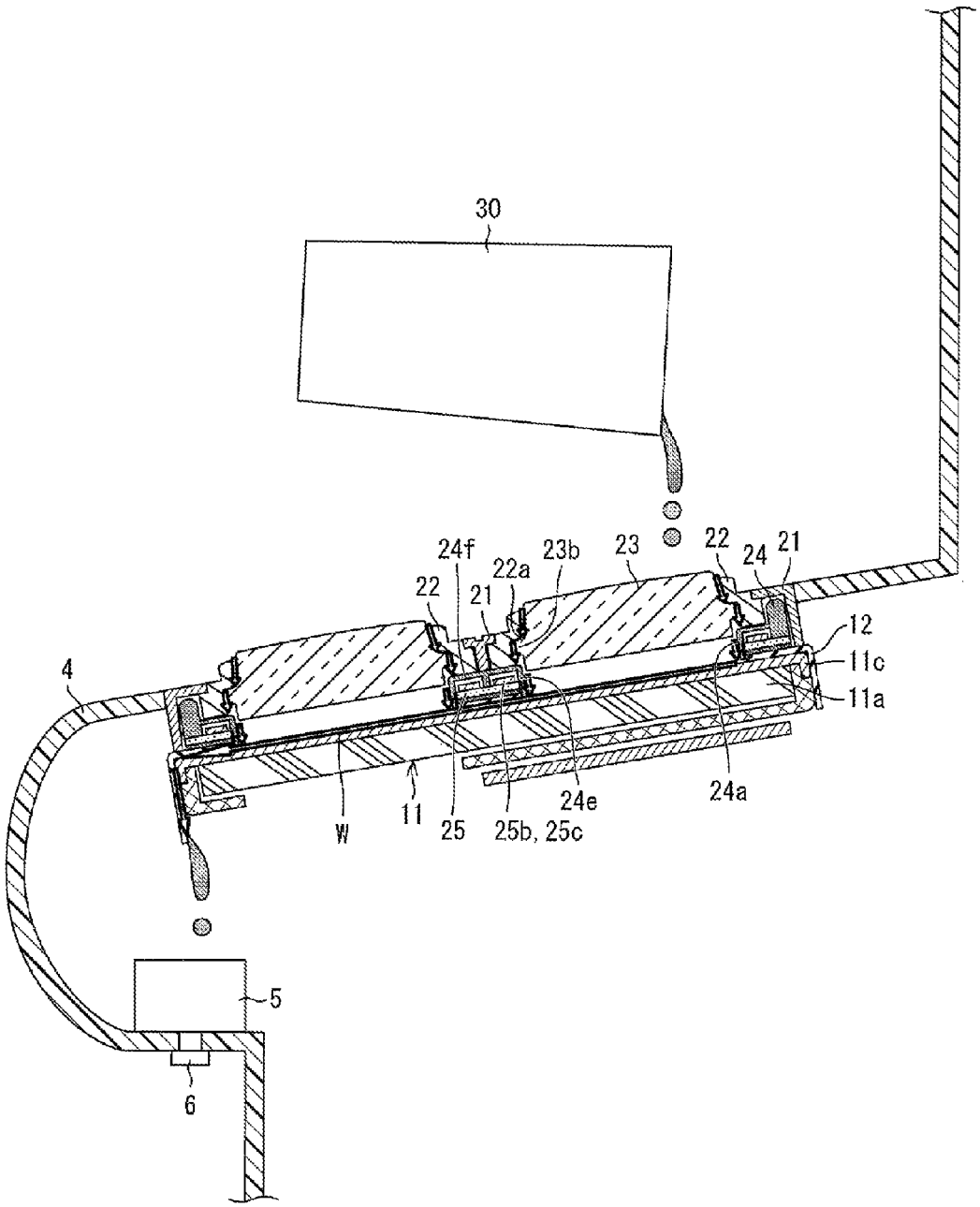
FIG. 1 is a cross-sectional view illustrating a switch unit according to one or more embodiments of the present invention, specifically, illustrating the configuration of the switch unit.

Therefore, as illustrated in FIG. 1, when liquid such as drinking water put in a glass 30 is spilled onto the switch unit 10, the liquid flows through a gap between the button case opening 21*a* and the operating button 23. As a result, the liquid may enter the electrode terminals 25*b*, 25*b* of the PCB 25 located below the operating button case 21. Further, in one or more embodiments of the present invention, since the PCB 25 is further equipped with the LEDs 25*c* which illuminate the areas surrounding the respective operating buttons 23, the water-proof structure for the LEDs 25*c* is also required.

Therefore, in one or more embodiments of the present invention, the rubber sheet 24 made of an elastic member is provided between the LCD 11*a* and the operating buttons 23. The rubber sheet 24 has the sheet openings 24*a* with which the respective operating buttons 23 are loosely fitted so as to be freely pressed down, the carbon electrodes 24*d* which are provided so as to face and come into contact with the electrode terminals 25*b*, 25*b* of the PCB 25 to cause conduction of the electrode terminals 25*b*, 25*b* by pressing down the operating buttons 23, the down portion 24*e* which covers the circumference of the PCB 25, and the light transmitting portion 24*f* (described later) which is formed on the top surface of the rubber sheet 24 to transmit light from the LEDs 25*c* therethrough.

Accordingly, the electrode terminals 25*b*, 25*b* and the LEDs 25*c* are provided in the PCB 25, and the PCB 25 is sealed by the surface of the rubber sheet 24 and the down portion 24*e* which covers the circumference of the PCB 25. In this case, since the rubber sheet 24 is made of an elastic member such as silicone rubber, the lower end of the down portion 24*e* of the rubber sheet 24 can be closely attached to the LCD 11*a*.

Therefore, even if liquid flows through a gap between the button case opening 21*a* and the operating button 23, after the liquid reaches the rubber sheet 24, the liquid flows along the surface of the down portion 24*e* on the rubber opening side, and then drops onto the protection sheet 11*c* provided over the LCD 11*a* as illustrated in FIG. 1. When the switch unit 10 is provided in an inclined manner in the slot machine 1, the liquid W flows downward. As a result, the electrode terminals 25*b*, 25*b*, the carbon electrodes 24*d*, and the LEDs 25*c* do not get wet.

Therefore, the switch unit 10 that has an appropriate water-proof structure for the carbon electrodes 24*d*, the electrode terminals 25*b*, 25*b*, and the LEDs 25*c* when a light emitting presentation is performed around the operating buttons 23 by the LEDs 25*c*.

As illustrated in FIG. 1, in the switch unit 10 of one or more embodiments of the present invention, a liquid storage container 5 can be provided at one end side of the protection sheet 11*c*. Accordingly, when the switch unit 10 is provided in an inclined manner, the liquid W enters a gap between the button case opening 21*a* and the operating button 23, and the sheet opening 24*a*, passes through the PCB opening 25*a* of the PCB 25, reaches the top surface of the translucent protection sheet 11*c* which covers the surface of the LCD 11*a*, and is then stored in the liquid storage container 5 which is provided at one end side of the protection sheet 11*c*, that is, the downstream side of the liquid W.

Therefore, the liquid W that has been spilled onto the switch unit 10 does not stay on the top surface of the protection sheet 11*c* for a long time.

Further, in one or more embodiments of the present invention, the liquid storage container 5 can be provided with a drain cock 6 which communicates with the outside of the casing 4 of the slot machine 1 on which the switch unit 10 is placed. As a result, the liquid W stored in the liquid storage container 5 can be easily taken out therefrom on the outside of the slot machine 1.

Further, the switch unit 10 of one or more embodiments of the present invention has a structure that can be easily taken apart and cleaned even when the liquid W stays inside thereof. In other words, the switch unit 10 of one or more embodiments of the present invention has an easily maintainable structure in which even when an image of the LCD 11*a* is made difficult to see due to the dropped liquid W, the liquid W can be easily wiped off.

In one or more embodiments of the present invention, the light guide frame bodies 22 are provided around the respective operating buttons 23, and the LEDs 25*c* are provided below the light guide frame bodies 22 with the rubber sheet 24 interposed therebetween. Therefore, in such a switch unit 10 which performs a light emitting presentation around the operating buttons 23 by the LEDs 25*c*, if light around an operating button 23 enters another operating button 23 that is adjacent thereto, an appeal made by the light emission becomes difficult to recognize.

Figure 10:
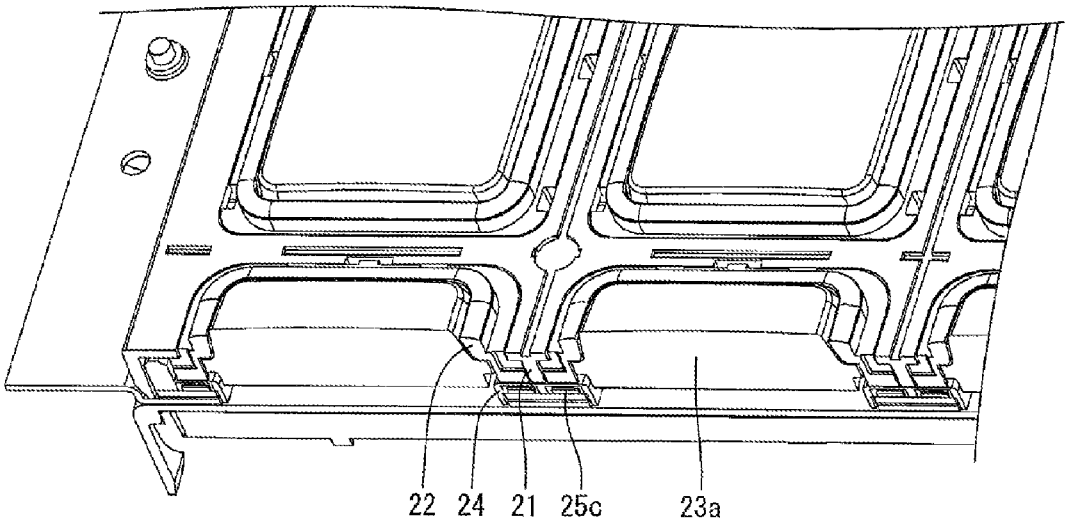
FIG. 10 is a main part perspective view illustrating the configuration of the operating button in the button unit.
Figure 12:
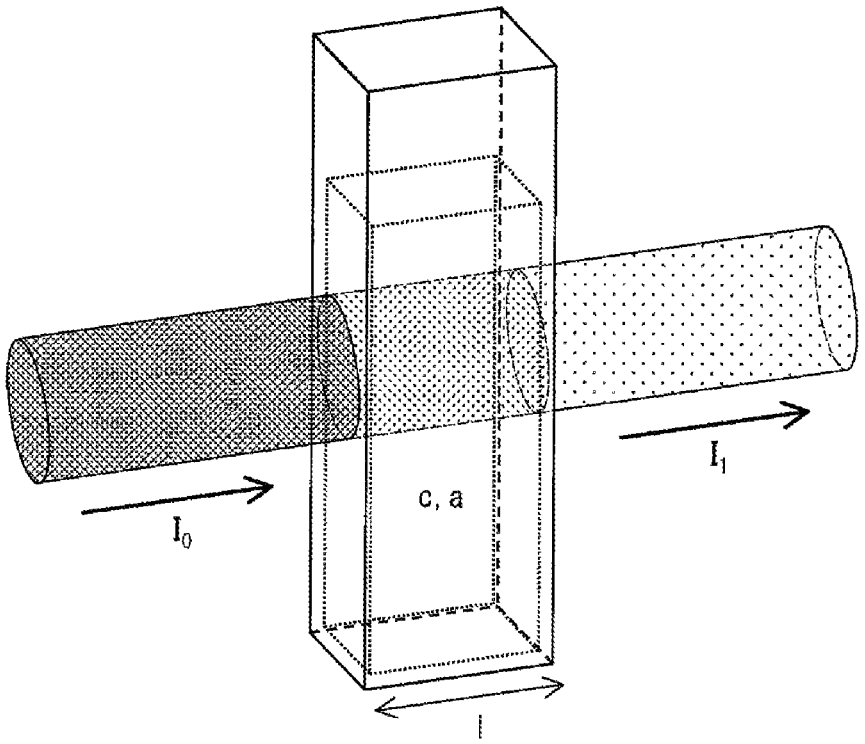
FIG. 12 is a schematic view illustrating the absorbance of light passing through a medium.
Figures 13A, 13B:
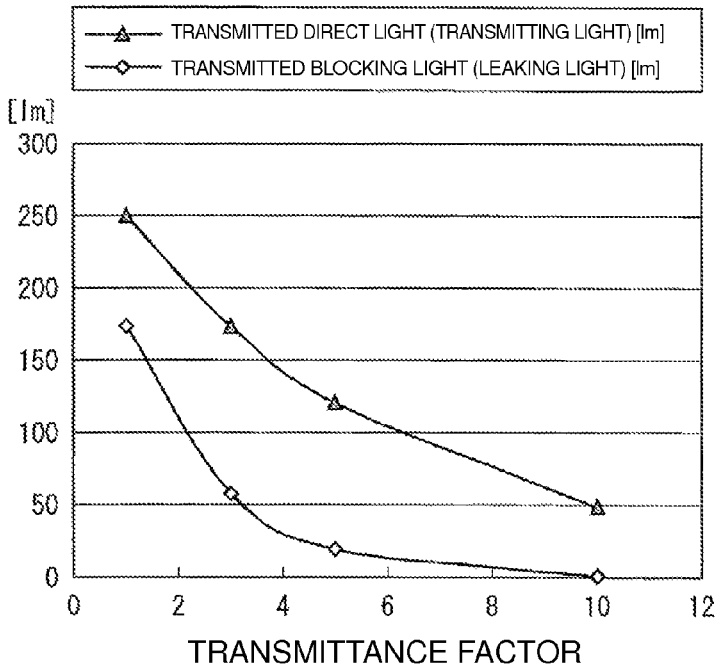
FIG. 13A is a graph illustrating changes in transmitted light when changing the absorption coefficient while the thickness of the light transmitting portion and the thickness of the light blocking portion of the rubber sheet are fixed at 0.3 mm and 0.9 mm, respectively.
FIG. 13B is a table illustrating data in FIG. 13A.

Hereinbelow, the light partition structure of the switch unit 10 of one or more embodiments of the present invention will be described in detail with reference to FIGS. 10 to 13B. FIG. 10 is a main part perspective view illustrating the configuration of the operating button in the button unit. FIG. 11 is a cross-sectional view illustrating the light source, and the light transmitting portion and the light blocking partition of a rubber sheet in the button unit. FIG. 12 is a schematic view illustrating the absorbance of light passing through a medium. FIG. 13A is a graph illustrating changes in transmitted light when changing the absorption coefficient while the thickness of the light transmitting portion and the thickness of the light blocking portion of the rubber sheet are fixed at 0.3 mm and 0.9 mm, respectively, and FIG. 13B is a table illustrating data in FIG. 13A.

In one or more embodiments of the present invention, as illustrated in FIGS. 10 and 11, the operating button case 21 is provided with the partitions 21*b* each of which blocks light leaking through a gap between adjacent ones of the operating buttons 23. Therefore, it is possible to prevent light from LEDs 25*c* around an operating button 23 from being irregularly reflected and thereby entering the presentation performed around another operating button 23 adjacent thereto by the corresponding partition 21*b*.

Next, the light partition structure of the rubber sheet 24 will be described below.

As illustrated in FIG. 11, in the switch unit 10 of one or more embodiments of the present invention, the LEDs 25*c* are provided below the rubber sheet 24. Therefore, if light from the LEDs 25*c* is blocked by the top surface of the rubber sheet 24, the switch unit 10 cannot perform a light emitting presentation by the LEDs 25*c*.

Therefore, in one or more embodiments of the present invention, as illustrated in FIG. 11, the light transmitting portion 24*f* which transmits light from the LEDs 25*c* therethrough is provided directly above the LEDs 25*c* in the rubber sheet 24. Therefore, the light emitting presentation by the LEDs 25*c* can be ensured.

Further, as illustrated in FIG. 11, the rubber sheet 24 is made of one kind of elastic member having a color, for example, a gray color in order to reduce cost in the switch unit 10 of one or more embodiments of the present invention. In addition, a part of the rubber sheet 24 other than the light transmitting portion 24*f* is formed as a light blocking portion which blocks light from the LEDs 25*c*. The light transmitting portion 24*f* is thinner than the light blocking portion. In one or more embodiments of the present invention, the rubber sheet 24 has, for example, a gray color. However, the present invention is not limited thereto, and the rubber sheet 24 may have another color, that is, a chromatic color.

Further, as illustrated in FIG. 11, the rubber sheet 24 is provided with the light blocking partition 24*g* which is formed of the light blocking portion to block light between adjacent LEDs 25*c*, 25*c* in the switch unit 10 of one or more embodiments of the present invention. Accordingly, it is possible to prevent light from LEDs 25*c* around an operating button 23 from entering the presentation performed around another operating button 23 adjacent thereto through the inside of the rubber sheet 24 by virtue of the light blocking partition 24*g* formed of the light blocking portion.

Therefore, it is possible to provide the switch unit 10 that has a light partition structure that prevents light in an operating button 23 from leaking to another operating button 23 adjacent thereto.

As illustrated in FIG. 11, in one or more embodiments of the present invention, in order to arrange an operating button 23 that is as large as possible in a certain area, a gap between adjacent LEDs 25*c*, 25*c* and a thickness ΔW of the light blocking partition 24*g* is made as thin as possible. Therefore, although the light blocking partition 24*g* serves as the light blocking portion for preventing the leakage of light between adjacent LEDs 25*c*, 25*c*, the thickness ΔW of the light blocking partition 24*g* is reduced as thin as possible, namely, reduced to 0.9 mm.

Further, the thickness Δt of the light transmitting portion 24*f* of the rubber sheet 24 is set at 0.3 mm. In this manner, in one or more embodiments of the present invention, a water-proof and presentation light transmitting function of the surface above the LEDs 25*c* is achieved. In addition, in order to achieve a function of preventing the leakage of light between adjacent LEDs 25*c*, 25*c*, the thickness of the light transmitting portion 24*f* and the thickness of the light blocking partition 24*g* are made different from each other.

With regard to the switch unit 10 of one or more embodiments of the present invention, a principle of having the above configuration will be described with reference to FIG. 12. FIG. 12 is a schematic view illustrating the absorbance of light passing through a medium.

As illustrated in FIG. 12, when light enters a medium having an absorption coefficient α, a mol concentration c, a length l, and a light path length L, an absorbance Aλ in the medium becomes as follows by the Lambert-Beer law, where the intensity of the light before entering the medium is $I_o$ and the intensity of the light after passing through the medium is $I_1$.

$$A\lambda=-\log(I_1/I_0)=\alpha cl\sim 0.434\alpha L$$

Herein, for example, when the medium is translucent white silicone rubber, the absorption coefficient α is 1.4. In this case, when the thickness of the silicone rubber is set at, for example, 0.3 mm, the light path length L is 0.3 mm. Therefore, the absorbance $A\lambda_{(0.3)}$ is $A\lambda_{(0.3)}=0.434\times1.4\times0.3$. Further, a transmittance $T_{(0.3)}$ is $T_{(0.3)}=\exp(-A\lambda_{(0.3)})=0.8326=83.3\%$.

On the other hand, when the thickness of the translucent white silicone rubber is set at, for example, 0.9 mm, the light path length L is 0.9 mm. Therefore, a transmittance $T_{(0.9)}$ is $T_{(0.9)}=\exp(-A\lambda_{(0.9)})=0.5772=57.7\%$.

$$\text{Therefore, transmittance } T_{(0.3)}\text{:transmittance } T_{(0.9)}=83.3:57.7=1.4:1 \quad \text{(Equation 1)}$$

On the other hand, when the medium is gray silicone rubber, the absorption coefficient α is 7.0. In this case, when the thickness of the gray silicone rubber is set at, for example, 0.3 mm, the light path length L is 0.3 mm. Therefore, the absorbance $A\lambda_{(0.3)}$ is $A\lambda_{(0.3)}=0.434\times7.0\times0.3$. The transmittance $T_{(0.3)}$ is $T_{(0.3)}=\exp(-A\lambda_{(0.3)})=0.4001=40.0\%$.

Further, when the thickness of the gray silicone rubber is set at, for example, 0.9 mm, the light path length L is 0.9 mm. Therefore, the transmittance $T_{(0.9)}$ is $T_{(0.9)}=\exp(-A\lambda_{(0.9)})=0.0641=6.4\%$.

$$\text{Therefore, transmittance } T_{(0.3)}\text{:transmittance } T_{(0.9)}=40.0:6.4=6.3:1 \quad \text{(Equation 2)}$$

As a result, judging from Equation 1, it is understood that, by changing the thickness from 0.3 mm to 0.9 mm in the translucent white silicone rubber, there arises a difference of 1.4 times between the transmittance $T_{(0.3)}$ and the transmittance $T_{(0.9)}$.

Further, when the silicone rubber has a gray color, it is understood from Equation 2 that, by changing the thickness from 0.3 mm to 0.9 mm, the difference between the transmittance $T_{(0.3)}$ and the transmittance $T_{(0.9)}$ can be expanded to 6.3 times.

From the above fact, it would appear that, when the rubber sheet 24 which is made of silicone rubber is used, a difference between light transmission and light blocking can be more easily made when gray silicone rubber is used than when translucent white silicone rubber is used.

When gray silicone rubber is used, gray includes various levels of gray within colors darker than white as well as lighter than black. Therefore, while the thickness of the light transmitting portion 24*f* was fixed at 0.3 mm and the thickness of the light blocking portion was fixed at 0.9 mm, a level of gray was examined with respect to light gray, medium gray, and dark gray. That is, the absorption coefficient was changed.

As a result, as illustrated in FIGS. 13A and 13B, a difference between transmitted direct light (transmitting light) and transmitted blocking light (leaking light) becomes large when a transmittance factor is three to five. That is, when the color is made dark to increase the absorption coefficient, the difference between the transmitting light that passes through the light transmitting portion 24*f* and the blocking light that passes through the light blocking portion becomes large. However, the absorption coefficient exceeds seven, the difference becomes small.

Therefore, when the difference between the thickness of the light transmitting portion 24*f* and the thickness of the light blocking portion is set at three times, the absorption coefficient according to one or more embodiments of the present invention is four to seven and, according to one or more embodiments of the present invention, is around seven. That is, according to one or more embodiments of the present invention, the silicone rubber has a gray color within the range from light gray having a transmittance factor of three up to medium gray having a transmittance factor of five.

Figures 14A, 14B:
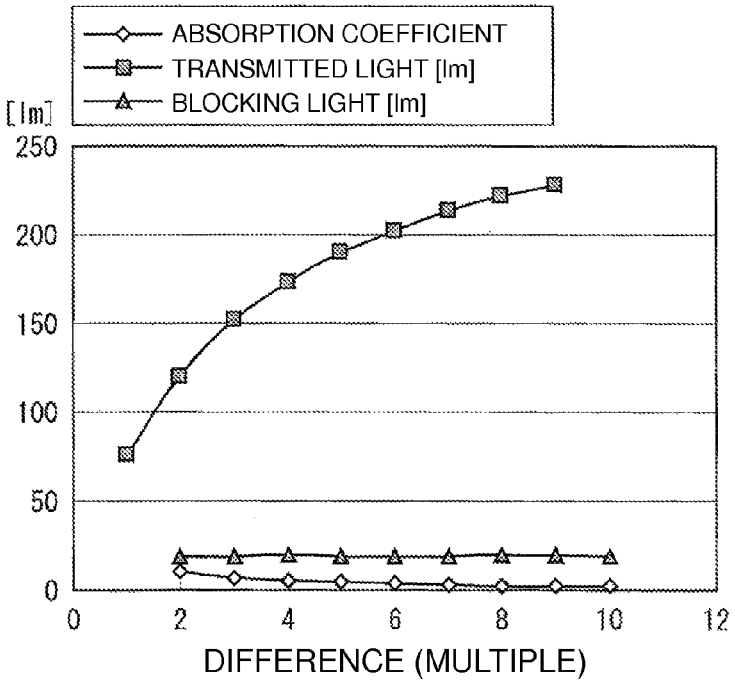
FIG. 14A is a graph illustrating a relationship between the absorption coefficient, transmitting light, and blocking light when changing the thickness of the light blocking partition while the blocking light is made equal to or less than 20 lm so as to be difficult to visually recognize, and the thickness of the light transmitting portion is fixed at 0.3 mm as a limit of a member.
FIG. 14B is a table illustrating data in FIG. 14A.

Next, the thickness of the light transmitting portion 24*f* and the thickness of the light blocking portion will be described with reference to FIGS. 14A and 14B. FIG. 14A is a graph illustrating a relationship between the absorption coefficient, transmitting light, and blocking light when changing the thickness of the light blocking partition while the blocking light is made equal to or less than 20 lm so as to be difficult to visually recognize, and the thickness of the light transmitting portion is fixed at 0.3 mm as a limit of a member, and FIG. 14B is a table illustrating data in FIG. 14A.

As illustrated in FIGS. 14A and 14B, when the difference between the thickness of the light transmitting portion 24*f* and the thickness of the light blocking portion is equal to or less than twice, the transmitting light does not exceeds 100 lm even if adjusting the absorption coefficient. However, when the difference between the thickness of the light transmitting portion 24*f* and the thickness of the light blocking portion is made three times or more, it is possible to combine conditions of transmitting light of 100 lm or more and blocking light of 20 lm or less. Although depending on restrictions of the layout of the buttons and the size of the buttons, this condition is, for example, satisfied even if the difference in the thicknesses exceeds three times when there is a dimension margin.

On the other hand, the difference in the thicknesses exceeds seven times, a change in the absorption coefficient becomes small. Therefore, an appropriate range of the difference between the thickness of the light transmitting portion 24*f* and the thickness of the light blocking portion is three to seven times. By selecting the absorption coefficient according to the thicknesses, it is possible to select an optimal combination of the layout and the light emission.

As described above, the switch unit 10 of one or more embodiments of the present invention is provided with: the display unit 11 which displays an image in at least one input area; the PCB 25 provided above the display unit 11, the PCB 25 having the electrode terminals 25*b*, 25*b* and the PCB opening 25*a* which allows the image in the input area of the display unit 11 to be viewed from above; the operating button case 21 which has the at least one button case opening 21*a* and covers the PCB 25; and the at least one translucent operating button 23 which is provided so as to be freely pressed down through the button case opening 21*a* of the operating button case 21 and causes conduction of the electrode terminals 25*b*, 25*b* by being pressed down. Further, the PCB 25 is further equipped with the LEDs 25*c* which illuminate an area surrounding the operating button 23. Furthermore, the rubber sheet 24 made of an elastic member is provided between the display unit 11 and the operating button 23 to cover the PCB 25. The rubber sheet 24 has the sheet opening 24*a* at a position facing the input area. The rubber sheet 24 is provided with the carbon electrodes 24*d* which are provided so as to face and come into contact with the electrode terminals 25*b*, 25*b* of the PCB 25 to cause conduction of the electrode terminals 25*b*, 25*b* by pressing down the operating button 23, the down portion 24*e* which covers the circumference of the PCB 25, and the light transmitting portion 24*f* which is formed on the top surface of the rubber sheet 24 to transmit light from the LEDs 25*c* therethrough.

Accordingly, the electrode terminals 25*b*, 25*b* and the LEDs 25*c* are provided in the PCB 25, and the PCB 25 is sealed by the surface of the rubber sheet 24 and the down portion 24*e* which covers the circumference of the PCB 25. In this case, since the rubber sheet 24 is made of an elastic member, the lower end of the down portion 24*e* of the rubber sheet 24 can be closely attached to the display unit 11.

Therefore, even if liquid flows through a gap between the button case opening 21*a* and the operating button 23, after the liquid reaches the rubber sheet 24, the liquid flows along the surface of the down portion 24*e* on the side of the sheet opening 24*a*, and then drops onto the protection sheet 11*c* of the display unit 11. As a result, the electrode terminals 25*b*, 25*b* and the LEDs 25*c* do not get wet.

Further, in one or more embodiments of the present invention, the rubber sheet 24 is provided with the light transmitting portion 24*f* which is formed on the top surface thereof to transmit light from the LEDs 25*c* therethrough. Therefore, the light emitting presentation by the LEDs 25*c* is ensured.

Therefore, the switch unit 10 that has an appropriate water-proof structure for the electrode terminals 25*b*, 25*b* and the LEDs 25*c* when a light emitting presentation is performed around the operating button 23 by the LEDs 25*c*.

Further, in the switch unit 10 of one or more embodiments of the present invention, the rubber sheet 24 is made of one kind of elastic member having a color, for example, a gray color. In addition, a part of the rubber sheet 24 other than the light transmitting portions 24*f* is formed as the light blocking portion which blocks light from the LEDs 25*c*. Further, the light transmitting portion 24*f* is thinner than the light blocking portion.

Further, according to one or more embodiments of the present invention, a part of the rubber sheet 24, the part being required for the light emitting presentation, transmits light therethrough, but the other part blocks light.

Therefore, in the switch unit 10 of one or more embodiments of the present invention, the rubber sheet 24 is made of one kind of elastic member having a color, for example, a gray color. In addition, a part of the rubber sheet 24 other than the light transmitting portions 24*f* is formed as the light blocking portion which blocks light from the LEDs 25*c*. Further, the light transmitting portion 24*f* is thinner than the light blocking portion.

As a result, the part required for the light emitting presentation is ensured by the thin light transmitting portion 24*f* and light blocking in the other part is appropriately ensured by the light blocking portion thicker than the light transmitting portion 24*f* by virtue of the thickness and the color of the one kind of rubber sheet 24.

That is, the rubber sheet 24 is made of, for example, an elastic member such as rubber. In such an elastic member, the absorbance of light is proportional to the thickness and the color thereof. Therefore, in one or more embodiments of the present invention, the light transmitting portion 24*f* of the rubber sheet 24 is made thinner than the light blocking portion thereof, and the rubber sheet 24 has a color such as gray.

As a result, the part required for the light emitting presentation is ensured by the thin light transmitting portion 24*f* and light blocking in the other part is appropriately ensured by virtue of the light blocking portion thicker than the light transmitting portion 24*f* by the thickness and the color of the one kind of rubber sheet 24.

Further, in the switch unit 10 one or more embodiments of the present invention, the rubber sheet 24 is made of silicone rubber having a color such as gray and an absorption coefficient of four to seven. Accordingly, the part required for the light emitting presentation is ensured by the thin light transmitting portion 24*f* and light blocking in the other part is appropriately ensured by the light blocking portion thicker than the light transmitting portion 24*f* by virtue of the thickness and the gray color having an absorption coefficient of four to seven of the one kind of silicone rubber which is easily available.

Further, in the switch unit 10 of one or more embodiments of the present invention, the rubber sheet 24 is provided with the light blocking partition 24*g* which is formed of the light blocking portion to block light between adjacent LEDs 25*c* in the switch unit 10 of one or more embodiments of the present invention. That is, in such a switch unit 10 of one or more embodiments of the present invention which performs a light emitting presentation around the operating buttons 23 by the LEDs 25*c*, if light around an operating button 23 enters another operating button 23 that is adjacent thereto, an appeal made by the light emission becomes difficult to recognize.

Therefore, in one or more embodiments of the present invention, the rubber sheet 24 is provided with the light blocking partition 24*g* which is formed of the light blocking portion to block light between adjacent LEDs 25*c* in one or more embodiments of the present invention. Accordingly, it is possible to prevent light from LEDs 25*c* around an operating button 23 from entering the presentation performed around another operating button 23 adjacent thereto through the inside of the rubber sheet 24 by virtue of the light blocking partition 24*g* formed of the light blocking portion.

Therefore, it is possible to provide the switch unit 10 that has a light partition structure that prevents light in an operating button 23 from leaking to another operating button 23 adjacent thereto.

Further, the light blocking partition 24*g* is formed of the light blocking portion, and formed on substantially the center of the thin light transmitting portion 24*f* which is formed on the surface of the rubber sheet 24. Therefore, the light blocking partition 24*g* has a function as a thick rib. As a result, it is possible to prevent the light transmitting portion 24*f* having a thin film thickness from warping to thereby prevent dropped liquid from staying thereon.

Further, the slot machine 1 of one or more embodiments of the present invention is provided with the switch unit 10 of one or more embodiments of the present invention.

Therefore, it is possible to provide the slot machine 1 that is provided with the switch unit 10 that has an appropriate water-proof structure for the electrode terminals 25*b*, 25*b* and the LEDs 25*c* when a light emitting presentation is performed around the operating button 23 by the LEDs 25*c*.

The present invention is not limited to the above embodiments, and various modifications can be made within the scope of the invention defined in the accompanying claims. The technical scope of the present invention also includes an embodiment that is obtained by appropriately combining technical means disclosed above.

One or more embodiments of the present invention relates to a switch unit that has a display part having an improved operational feeling and a game machine equipped with the same. One or more embodiments of the present invention can be applied to a switch unit that has an input part above a display part such as an LCD. The game machine can be applied not only to a slot machine, but also to a poker game machine, a mah-jong game machine, a card game machine and the like.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A switch unit comprising:

a display part that displays an image in at least one input area;

a substrate provided above the display part, the substrate comprising:

a contact, and at least one substrate opening configured to allow the image in the at least one input area to be viewed from above;

an operating button case that covers the substrate, comprising at least one button case opening;

at least one operating button that has translucency, and that is freely pressed down through the at least one button case opening of the operating button case and causes conduction of the contact by being pressed down;

light sources mounted on the substrate, that illuminate an area surrounding the at least one operating button; and a light transmissive water-proof sheet made of an elastic member, wherein the light transmissive water-proof sheet is provided between the display part and the at least one operating button to cover the substrate, wherein the light transmissive water-proof sheet comprises at least one sheet opening formed thereon at a position facing the at least one input area, wherein the light transmissive water-proof sheet comprises:

a contact conducting portion that faces and comes into contact with the contact of the substrate to cause conduction of the contact by pressing down the at least one operating button, a down portion that covers a circumference of the substrate, and a light transmitting portion formed on a top surface thereof, that transmits light from the light sources therethrough, wherein the light transmissive waterproof sheet comprises one kind of colored elastic member, wherein a part of the light transmissive water-proof sheet other than the light transmitting portion formed as a light blocking portion that blocks light from the light sources, and wherein the light transmitting portion is thinner than the light blocking portion.

2. The switch unit according to claim 1, wherein the light transmissive water-proof sheet comprises colored silicone rubber having an absorption coefficient of four to seven.

3. The switch unit according to claim 2, wherein the light transmissive water-proof sheet comprises a light blocking partition configured to block light between adjacent ones of the light sources and formed of the light blocking portion.

4. The switch unit according to claim 2, wherein a light diffusion frame configured to be fitted around the at least one operating button and direct light from the light sources along the circumference of the at least one operating button are provided in the at least one button case opening of the operating button case.

5. A game machine comprising:

a display monitor, and the switch unit according to claim 2.

6. The switch unit according to claim 1, wherein the light transmissive water-proof sheet comprises a light blocking partition configured to block light between adjacent ones of the light sources and formed of the light blocking portion.

7. The switch unit according to claim 6, Wherein a light diffusion frame configured to be fitted around the at least one operating button and direct light from the light sources along the circumference of the at least one operating button are provided in the at least one button case opening of the operating button case.

8. A game machine comprising:

a display monitor, and the switch unit according to claim 6.

9. The switch unit according to claim 1, wherein a light diffusion frame that is fitted around the at least one operating button and directs light from the light sources along the circumference of the at least one operating button is provided in the at least one button case opening of the operating button case.

10. A game machine comprising:

a display monitor, and the switch unit according to claim 9.

11. A game machine comprising:

a display monitor, and the switch unit according to claim 1.

12. The switch unit according to claim 1, wherein a light diffusion frame configured to be fitted around the at least one operating button and direct light from the light sources along the circumference of the at least one operating button are provided in the at least one button case opening of the operating button case.

* * * * *